US006467560B1

(12) United States Patent
Anderson

(10) Patent No.: US 6,467,560 B1
(45) Date of Patent: Oct. 22, 2002

(54) RECREATIONAL DEVICES

(75) Inventor: Glenn James Anderson, Mount Lyford (NZ)

(73) Assignee: DirtThingz (NZ) Ltd., Christchurch (NZ)

( * ) Notice: Subject to any disclaimer, the term of this patent is extended or adjusted under 35 U.S.C. 154(b) by 0 days.

(21) Appl. No.: 09/601,832

(22) PCT Filed: Feb. 3, 1999

(86) PCT No.: PCT/NZ99/00012

§ 371 (c)(1),
(2), (4) Date: Aug. 3, 2000

(87) PCT Pub. No.: WO99/39787

PCT Pub. Date: Aug. 12, 1999

(30) Foreign Application Priority Data

Feb. 3, 1998 (NZ) ..... 329715

(51) Int. Cl.[7] ..... A63C 17/12; B60K 17/34

(52) U.S. Cl. ..... 180/181; 180/237; 180/240; 280/87.042

(58) Field of Search ..... 180/180, 181, 180/237, 240; 280/87.042, 87.021, 87.01

(56) References Cited

U.S. PATENT DOCUMENTS 2,625,229 A * 1/1953 Van Voorhees ..... 180/180
4,069,881 A * 1/1978 Shiber ..... 180/180
4,073,356 A * 2/1978 Schlicht ..... 180/180
4,508,187 A * 4/1985 Wenzel ..... 180/180
5,020,621 A * 6/1991 Martin ..... 180/181
5,048,632 A * 9/1991 Battel ..... 180/181
5,474,314 A * 12/1995 Lehman ..... 280/87.042
5,551,717 A * 9/1996 De Courcey Milne . 280/87.042
5,794,955 A * 8/1998 Flynn ..... 280/87.042
5,819,865 A * 10/1998 Cowly ..... 180/181
5,950,754 A * 9/1999 Ondrish, Jr. ..... 180/181
5,975,229 A * 11/1999 Hosoda ..... 180/181
6,182,779 B1 * 2/2001 Hosoda ..... 180/180

FOREIGN PATENT DOCUMENTS

DE 3205379 8/1983
FR 2760382 4/1999

* cited by examiner

*Primary Examiner*—Brian L. Johnson
*Assistant Examiner*—Jeffrey Restifo
(74) *Attorney, Agent, or Firm*—Hovey Williams LLP

(57) ABSTRACT

A transmission unit for a recreational vehicle comprises: steering arrangement controlled by movement of the weight of the user, driving assembly which includes a free-wheeling clutch, suspension assembly and braking assembly. The vehicle also includes an engine (with gearbox and clutch) and a user support platform, and is adapted for use on any type of land surface, both on- and off-road. The unit is connected between the engine and at least one axle, through a drive. The vehicle may include wheels with balloon tyres as part of the adaption for all terrain capability. A remote control may be remote from the vehicle and hand-operable.

7 Claims, 9 Drawing Sheets

RECREATIONAL DEVICES

BACKGROUND OF THE INVENTION

1. Field of the Invention

The present invention is directed to a propelled vehicle capable of adaptation for off-road use, which use can be recreational. More particularly, the invention is directed to a transmission means enabling the construction and use of such a propelled vehicle. Preferred embodiments of the vehicle resemble a motorised skateboard adapted for off-road use.

The present invention is perhaps best described as a powered recreational vehicle. However, it should not be confused with conventional off-road vehicles based on cars, trucks or vans. If any analogy is to be made then it is perhaps best made in comparison with other forms of boarding, with skate boards and snow-boards perhaps being the closest of the known boarding techniques.

In the specification, the term 'vehicle' is used in the sense of a single person conveyance for use on land. The term 'on-road' is used to refer to a vehicle that requires a minimum standard of engine and accoutrements, generally recognised by the issue of a licence by a regulatory authority. The vehicle is then legally authorised to be used on public roads.

'Off-road' is used as the term referring to vehicles or use of vehicles in places that are not public roads and where operation of the vehicle requires no regulatory licence for minimum standards. Vehicles that can travel anywhere, on any land surface are vehicles that can cover 'all-terrains'.

Whilst the term 'board' is used to refer to a four wheeled platform capable of manual propulsion and of carrying one or more persons, generally for recreational use, the term is not limited to this definition in the specification. The term is also used to refer to a four wheeled, shaped motorised platform capable of travelling over all terrains, on- or off-road; and for uses which are not purely recreational. It is in this encompassing respect that the term 'vehicle' is used.

2. Description of the Prior Art

While the propelled vehicle of the present invention has been developed primarily for recreational use, it is envisaged that it may also find other uses, which include commercial or semi-commercial uses. However, for simplicity, the description herein is written primarily with the recreational aspects in mind.

A major difference between the present invention and the other known types of boarding is the means of propulsion. Snow boarding requires a slope, allowing gravity to propel the snow board and user forward. Surf boarding relies upon a wave while skate boarding relies on the user or an incline to propel the device forward. However, off-road or rugged terrain presents a different set of problems. Regardless of the design or shape of the tyres, attempting to push any form of wheeled board or vehicle across sandy or rugged terrain in the same manner as a skate board is impractical as well as difficult.

Accordingly, the present invention incorporates a form of motive means (non-manual) for propelling the vehicle across the ground. Various types of propelled boards have been popular for quite some time. Surf boarding is an extremely popular pastime and is considered to have given rise to skate boarding affording enjoyment to those for which surf boarding was not accessible or practical. However, skate boarding has evolved into a sport of its own.

Another off-shoot is snow boarding which has become as popular, if not more popular, than the more traditional types of skiing.

These demonstrate an enthusiasm by the public for sport and recreational pastimes based on board-riding. However, there are limitations associated with each of the known types of boarding described above. For instance, surf boarding relies on water as its medium, while snow boarding relies on snow. Skate boarding overcomes some of these restrictions by including wheels for travel though is generally restricted to hard or paved surfaces. However, there is nothing currently available, to the best of the applicant's knowledge, which allows motorised board-riding in off-road conditions. Given that escaping to the country is very popular for many city dwellers, as well as a significant non-urban resident population, there is a significant demand on sport and recreational activities which take place in remote or off-road areas. With this need at least partially in mind, the present invention was developed to enable popular board-riding type activities to take place in off-road conditions.

Propelled vehicles, generally described as motorised skateboards, are known. Examples of such can be seen in U.S. Pat. No. 4,073,356 (Schlicht), U.S. Pat. No. 4,094,372 (Notter), U.S. Pat. No. 4,274,647 (Drake Jr), U.S. Pat. No. 5,020,621 (Martin) and U.S. Pat . No. 5,381,870 (Kaufman).

Schlicht discloses a motorised skateboard where the drive means is through a fifth wheel which is positioned centrally with respect to the other four wheels. The motor is connected to the fifth wheel. However, the vehicle is not capable of all terrain travel, does not incorporate suspension means, and has primitive steering.

In Notter, the motorised skateboard has only two wheels which are capable of being driven via a chain drive. There is no suspension.

Drake Jr discloses an articulated, manually steerable skateboard. However, the articulation is required to be between the wheels. This requires that the user manually turn the front portion, via handles which are rigidly secured to the front portion, to steer the board. Such a skateboard does not have any suspension, and could not be capable of use in all terrains. The board disclosed does not include steering by inclination of the user platform of the vehicle.

Martin discloses an electrically driven brake for a skateboard in which the motor is connected to two wheels by a belt. Slippage of the belt acts as a clutch means to transfer power to the drive wheels. However, there is no ability for the skateboard to be an all terrain vehicle: there is no suspension nor transmission means.

In the patent to Kaufman the motorised skateboard has belt driven rear wheels The front wheels include a shock absorbing suspension. However, the skateboard is not adapted for all terrain travel.

However, in all the known motorised boards and the variations. as described above, there is no example of a vehicle that can reliably drive or be driven at the same time as the vehicle turns, as well as do each operation independently on all terrains. Further, in all prior art, the suspension, if present, is a separate mechanism from the drive means and the steering means and is not adequate for all-terrain use.

Further, none of the patents discussed disclose provision for free-wheeling assemblies, in connection with the vehicle, when the engine is idling or stopped, or to prevent engine braking during deceleration. Thus no prior art discloses a transmission unit for a vehicle which adequately incorporates transmission, steering, braking, free-wheeling and suspension for use in a vehicle as defined above, where the vehicle is capable of all terrain use.

It is an object of the present invention to address the foregoing problems by the provision of a mechanical unit that combines the features of steering, drive, suspension and braking; the unit operating optimally in a motorised vehicle (as defined above). it is a further object of the present invention to provide such a unit that also permits free-wheeling of each wheel and does so without a differential. It is a still further object of the present invention to at least provide the public with a useful choice.

Further aspects and advantages of the present invention will become apparent from the ensuing description which is given by way of example only.

SUMMARY OF THE INVENTION

According to one aspect of the present invention there is provided a transmission unit for a motorised vehicle which includes motive means, said unit including:

steering means for guiding the vehicle, whereby said steering means includes steering the vehicle by movement of the weight of the user relative to the centre of the vehicle;

means connectable to the motive means for driving the vehicle, said means including free-wheeling clutch means;

suspension means; and braking means; wherein said unit is connected between said motive means and at least one axle of the vehicle through a drive shaft; and wherein said steering means is capable of operation concurrently with said driving means.

According to another aspect of the present invention, there is provided a transmission unit, substantially as described above, wherein one or more wheels of the vehicle are connected with a free-wheeling assembly allowing coasting of the vehicle when not in controlled acceleration or deceleration. Such assembly may optionally be a free-wheeling hub assembly, or a free-wheeling axle assembly.

According to another aspect of the present invention, there is provided a transmission unit, substantially as described above, wherein wheels, associated with both steering and driving of the vehicle, are connected to the engine via either a ball joint or a spherical coupling, in combination with a drive assembly capable of transmitting torque passing through same.

According to another aspect of the present invention, there is provided a transmission unit for a recreational vehicle, substantially as described above, wherein the steering means of the recreational vehicle is connected through a front axle assembly of the unit.

According to another aspect of the present invention, there is provided a transmission unit for a recreational vehicle, substantially as described above, wherein steering of the recreational vehicle is effected through a rear axle assembly.

According to another aspect of the present invention there is provided a recreational vehicle comprising:

a user support portion;

wheel means enabling the recreational vehicle to travel across the ground;

an engine for propelling the vehicle; and said unit as described above.

According to another aspect of the present invention, there is provided a recreational vehicle, substantially as described above, wherein the user support portion comprises a platform on which the user may stand.

According to another aspect of the present invention there is provided a recreational vehicle, substantially as described above, wherein acceleration and/or deceleration of the recreational vehicle is controlled by a remote control unit in communication with the vehicle. Preferably the remote control unit comprises a hand held unit. More preferably the remote control unit utilises digital proportional control.

According to another aspect of the present invention, there is provided a recreational vehicle, substantially as described above, wherein the remote unit is a wireless unit.

According to another aspect of the present invention there is provided a recreational vehicle, substantially as described above, wherein the remote control unit is wired to the recreational vehicle.

According to another aspect of the present invention, there is provided a recreational vehicle, substantially as described above, wherein all wheels of the vehicle are driven.

According to another aspect of the present invention, there is provided a recreational vehicle, substantially as described above, wherein the wheels are adapted for all terrain travel (as hereinbefore defined).

Typically, embodiments of the vehicle of the present invention will comprise a supporting platform for a user. The typical and preferred form of riding or driving the present invention is with the user standing—as for other forms of board sports. Accordingly, the supporting portion for a user will typically comprise a platform allowing the user to stand on the device. The user support portion may take many forms. Quite simply it may be a flat platform resembling a skate- or snow-board. Also, means for retaining the feet of the user on the platform are provided, for example, straps.

There may be provision for clips or bindings (for example, as used on snow-boards). It is to be noted that due to the nature of the steering and the stability of the vehicle, self release clips, such as used on skis, are not applicable. The platform may be flat, or contoured, and may take the form of a body for the vehicle. However, whatever its configuration, it should be able to support the user, preferably in a stable manner allowing a skilled user to ride and control the vehicle.

The user support portion may be in substantially one piece, or may comprise a series of two or more portions or platforms. These may be articulated or otherwise connected with each other. For such embodiments it is envisaged that there will be two such platforms, with each foot of the user being placed on one of the two platforms. This may allow for independent control of certain functions, as will be discussed later herein.

Most embodiments of the vehicle of the present invention will also include wheels which are adapted for all types of terrain (as hereinbefore defined).

While all-purpose embodiments are envisaged, as with any type of sport or recreational equipment, embodiments soon evolve which are specialised for particular applications. For instance, it is envisaged that there will be embodiments which may be specific for wet or dry sandy conditions while there may be others for grassy or rocky type ground. Also envisaged are different embodiments adapted for use in snow, ice, and/or mud, and other off-road conditions. Other specialised conditions are also envisaged, including paved areas, and the vehicle of the present invention can be especially adapted for use on-road.

However, regardless of whether the embodiment is destined for general purpose or specialised use, preferably the wheels are suitable for supporting the vehicle (and user) and for allowing travel across the type of terrain for which the embodiment is envisaged. As it is envisaged that most applications of the present invention will be off-road, wider and/or balloon-type tyres with differing types of tread will be used for most embodiments.

A further embodiment of the present invention incorporates a unit and a vehicle having tracks rather than wheels for ground travel. This will typically be more effective on softer types of ground, and represents a further alternative to wheeled embodiments. It is envisaged that some embodiments may be easily modified or converted between wheels and tracks.

The motorised vehicle, with appropriate wheels or tracks, may be used in hilly areas, and may be ridden up inclines. In some respects, the present invention incorporates and combines some of the elements associated with off-road trail bike riding and skate boarding.

However, problems associated with off-road terrain means that the vehicle of the present invention comprises more than the addition of a motor to a skate board. That such a simple modification would fail to work effectively in off-road situations and would fail to overcome a number of difficulties which will become apparent from the following description.

To operate effectively in off-road terrain, it is preferred that embodiments of the present invention have 2-wheel-drive, 4-wheel-drive, or all-wheel-drive. It is envisaged that most embodiments of the present invention will comprise four wheels, typically distributed over two main axle assemblies or groupings. It is possible, however, that other embodiments may have other numbers of wheels and/or axle groupings etc. For simplicity however, the ensuing description will be directed primarily to embodiments having four wheels distributed over front and rear axle assemblies.

Steering may be accomplished by a number of different arrangements. In current embodiments of the present invention, steering is accomplished in a manner very similar to a standard skate board, that is, by altering the inclination of the user supporting platform. Typically the steering means is located about the front axle assembly, though it is also envisaged that similar arrangements may also be provided at other wheels/axle assemblies. These similar arrangements may be either in addition to, or instead of, steering arranged about the front axle assembly. Hence, in preferred embodiments, steering is accomplished by altering the forces acting on the user support portions associated with a particular axle assembly.

It is also envisaged that other forms of steering the vehicle may be implemented. For example, such forms may include powered steering of the wheels, which steering is controlled other than by altering the inclination of the user support portion. Such steering may be activated by the control means (to be described later) for controlling acceleration and braking. However, to maintain balance, it is generally desirable that steering is controlled by, or includes, altering the inclination of the user support portion or part thereof.

There may be modifications or variations to these arrangements. For instance, there may be power assisted steering, which accentuates or augments any sensed alteration of the inclination of the user support portion. Another example is an arrangement to allow steering in response to the actions perceived on one or more input sources. For example, steering by altering the inclination of the user support portion, as well as the steering being controllable from a separate control piece. For such an arrangement, it is also possible that one axle assembly is controlled by one method while the other is controlled by the alternative method. This may also introduce a new element of skill, excitement, and versatility into such embodiments.

A further difficulty associated with a combination of 4-wheel-drive or all-wheel-drive and steering is how to transmit drive to wheels which are being driven. In a preferred embodiment of the transmission unit of the invention, this problem is addressed by having ball joint or spherical coupling-type linkages in the axle assemblies associated with steering and providing a drive transmission linkage passing through these assemblies to drive the wheels of the vehicle.

This allows for altering the inclination of the user support platform relative to the wheels and axle assembly while still allowing drive to be transmitted to the wheel. It is envisaged that there are other solutions to allow for this which may be incorporated into the present invention, though the foregoing arrangement is adopted in preferred embodiments.

Another problem associated with the intended use of the vehicle of the present invention relates to the acceleration and deceleration of the vehicle. There are a number of options available for forward control of the vehicle, one of which is to have the motive means substantially continuously linked to the driving wheels through the transmission unit. Accordingly, by controlling the motor speed, the user may control the speed at which the vehicle travels. However, while this may be suitable for a vehicle whose main function is conveyance, it is perhaps not the most ideal arrangement for a sport/recreational-type vehicle. In addition, it may lead to increased fuel usage, regardless of whether the motive means is a combustible fuel or an electrical storage device.

Accordingly, preferred embodiments of the transmission unit of the present invention utilise free-wheeling assemblies for all wheels, enabling the vehicle to coast or free-wheel when not under controlled acceleration or de-acceleration. The free-wheeling assemblies may be optionally free-wheeling hub assemblies or free-wheeling axle assemblies. Either arrangement allows fuel to be conserved by employing the motor only when the user deems it necessary, rather than attempting to drive the vehicle continuously (though the motor may idle when free-wheeling). In addition, the characteristics of the vehicle when coasting or free-wheeling down a slope will be substantially different than when the motor is connected and attempting to brake the vehicle (engine braking). This is one further reason why a free-wheeling transmission arrangement is preferred for many embodiments.

A further consideration is the engine or motor itself. This may be any suitable small motor having a varying range of horse powers and motive power according to user preferences or requirements. Preferred embodiments may employ electric or fossil fuel motors, with the primary requirement being that the motor is reasonably compact. An example is a small capacity two or four stroke engine, such as a petrol driven motor, for example, such as is often used on go-carts. Often quite high power outputs are achievable from a small engine capacity and size. Diesel driven engines may also be used.

Electric power is also an option, with quite small motors providing high torque and power characteristics. Also, control of electric motors is simpler, though the disadvantage is the weight and size of the energy storage devices. However, recent advances in battery technology have provided high capacity, lightweight batteries (such as are more frequently being used in cellular phones and portable computers) which may be incorporated into the device. Hybrid technologies, for example the diesel-electric motor, may also be employed.

Another possibility is the use of a hydraulic pump to drive a hydraulic motor. This also opens up other possibilities, which may also be implemented with some other drive systems. This includes the use of a main engine separate from the vehicle to drive a motor mounted on the vehicle. An example is a backpack, worn by the user, which comprises an engine driving a hydraulic pump. Mounted on the vehicle is a hydraulic motor, powered by a hydraulic line between the pump and motor. Preferably quick-release, automatic close-off connections are used on these connecting lines, should the user and vehicle become separated.

The hydraulic pump may be driven by any type of engine technology, including small combustion engines, electric engines, etc.

The technique of separately mounted primary engines may also be implemented for other engine technologies. For instance, the diesel-electric arrangement would readily lend itself to such a scenario, with the electric motor mounted on the vehicle, perhaps with a number of batteries as a buffer to satisfy instantaneous or peak demand, and the diesel or other power generator carried remotely.

Energy conserving techniques may also be implemented on electric motor embodiments. This includes power-generation during deceleration to charge a storage device. Such techniques are known for conventional electrically powered vehicles.

One further advantage of electrically and hydraulically powered motors is their quiet operation which may make their use mandatory in areas having noise control regulations, a problem currently plaguing the use of water borne jet-skis near residential areas.

As can be appreciated, varying choices of motive means have different advantages and disadvantages, though all should be considered for varying applications of the present invention.

Control of the vehicle, apart from steering, is generally limited to acceleration and deceleration. Acceleration is typically achieved by controlling either or both the motor and transmission means, while deceleration may either rely on engine braking and/or a braking system. Various braking systems are known and may be implemented and will not be described in any detail here. However, envisaged braking systems include in-board disc braking, and various other forms of disc and/or drum braking. Such braking means may be centrally situated or be positioned adjacent the wheels or tracks.

Control is preferably via a remote unit in communication with the vehicle. A preferred embodiment utilises a hand operated device, though foot operated controls are also a possibility. Steering is achieved by varying the inclination of the user support platform. However, it has been previously discussed that some steering control may be achieved via a remote controlling unit.

Typically the remote controlling unit will at least allow for acceleration, and preferably also braking of the vehicle. The control unit will typically be in communication via a number of means, including wired and wireless communication methods. In a preferred embodiment, the controlling unit relies on proportional digital control, in the same manner as the remote controller for a model aeroplane or model car. However, any number of communication and control methods may be used.

Optionally, safety features may be built in. Obviously when other people may be around, the user does not wish an uncontrolled power device to be loose. Accordingly, the control device may incorporate features to shut down and halt the vehicle should the user become separated from the vehicle and/or the remote control unit. This may employ variations of the dead-man's switch. Examples include buttons on the control device which must be continuously pressed for use of the device, with release causing automatic engine shut down and braking of the vehicle.

Another example includes plugs or tags attached to the body of the user and plugged into either the vehicle and/or the control unit. When the user is separated from either the vehicle or controlling unit, one portion of the plug becomes separated from the second portion and effects shut down of the vehicle. Such devices may be electrical and/or mechanical in operation.

The main features and preferences of the present invention and preferred embodiments of same have been described in general. As can be appreciated, any number of variations of these features may be implemented on other embodiments of the present invention. Further modifications may also be made which do not necessarily alter the fundamental characteristics of the invention. It is considered that such variants and modified embodiments still fall within the scope of the present invention which, in its preferred form, resembles a motorised wheeled board which is ridden in the stand up position.

BRIEF DESCRIPTION OF DRAWINGS

Further aspects of the present invention will become apparent from the following description, which is given by way of example only and with reference to the accompanying drawings, in which.

DESCRIPTION OF THE PREFERRED EMBODIMENTS

Figure 1:
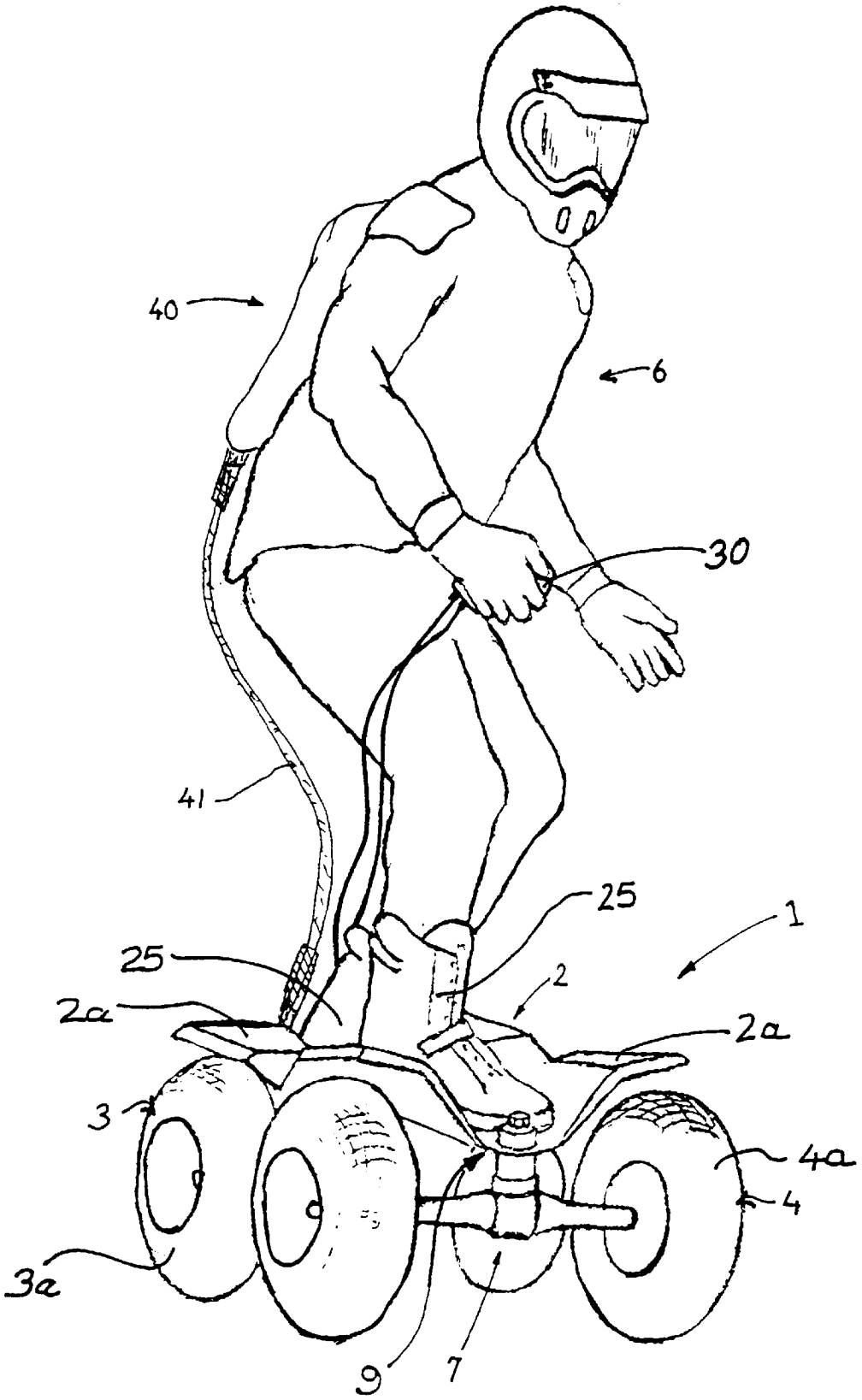
FIG. 1 is a perspective diagrammatic drawing of a rider using a preferred embodiment of the present invention.
Figure 2:
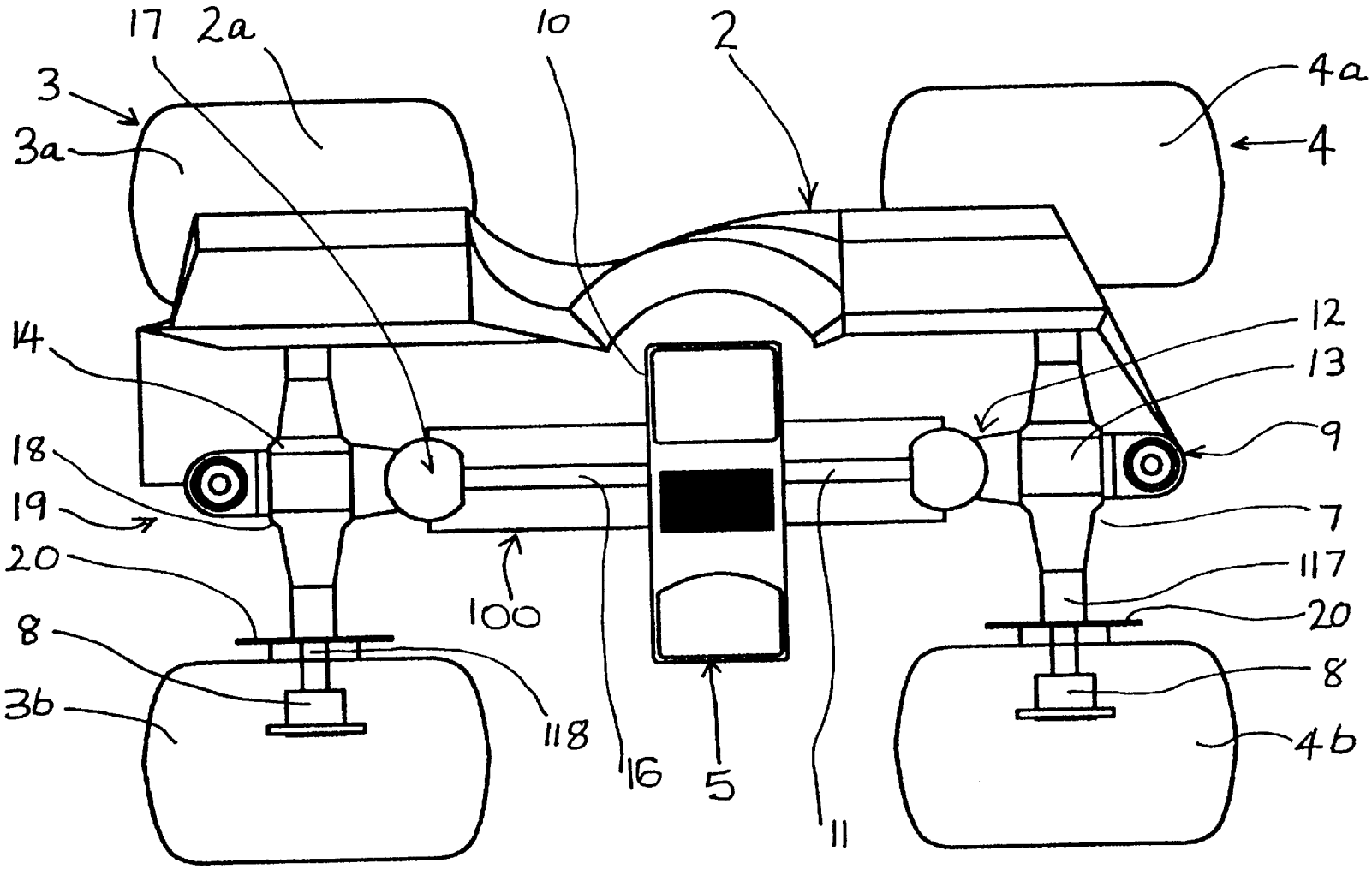
FIG. 2 is a plan diagrammatic cut-away view of a preferred embodiment of the present invention.
Figure 3:
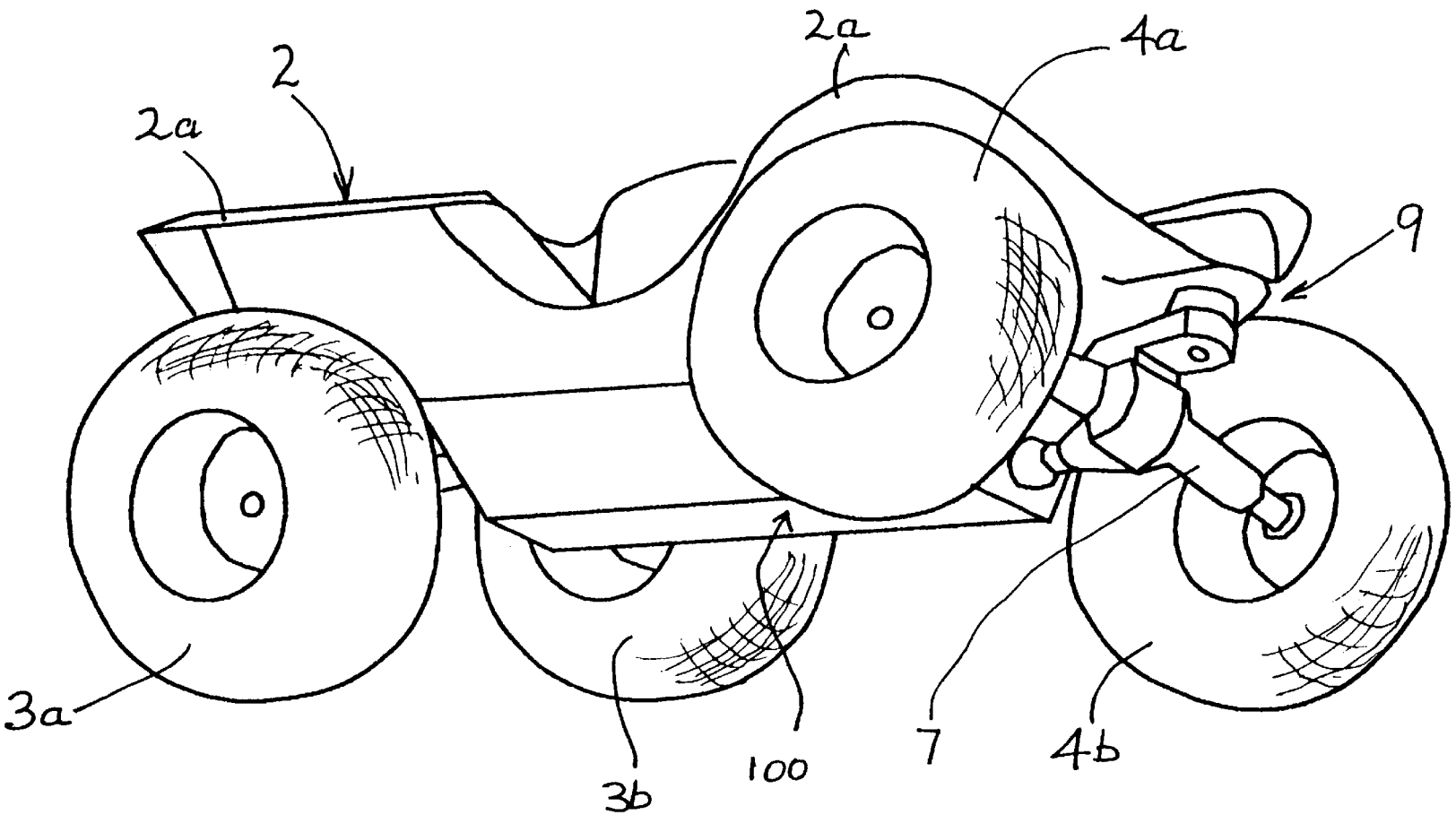
FIG. 3 is a perspective diagrammatic view of the embodiment of FIGS. 1 and 2.

With reference to the drawings, specifically FIGS. 1 to 3, and by way of example only, there is provided a recreational vehicle (1) (as defined above), comprising:

a user support portion (2);

wheels (3, 4) enabling the recreational vehicle (1) to travel across the ground; and an engine or motor (5).

FIG. 1 illustrates a preferred embodiment of the vehicle (1) of the present invention with a user (6) on board. This is a typically representative stance for the user (6) when riding the vehicle (1). Control is achieved by altering the inclination of the platform (2) upon which the user (6) stands, with respect to the front wheels (4) and axle assembly (7).

Also shown in FIG. 1 is a backpack (40), used on some alternative embodiments of the invention. Housed in such a backpack (40) is a small hydraulic pump powered by a small combustion engine. This backpack (40) is connected to the vehicle (1) by hydraulic lines (41) which pump hydraulic fluid to a hydraulic motor (not shown) for propulsion of the vehicle (1). Alternatively, the backpack (40) may contain a small electric generator, connected by power supply lines to the vehicle (1), which is propelled by an electric motor.

FIGS. 2 and 3 illustrate the preferred embodiment of the transmission unit (100).

Referring to FIGS. 1 to 3, the unit (100) includes a front axle assembly (7) and a rear axle assembly (19) mounted to the underside of the platform (2). Connected to the axle assembly (7) are wheels (4) with balloon tyres (4*a*, 4*b*), which are equivalent to the tyres (3*a*, 3*b*) of the wheels (3) at the rear of the vehicle (1). However, in other embodiments, different diameter wheels may be used on front and rear or differing axle assemblies (7, 19). Also different styles of wheels (3, 4) or tyres (3*a* and *b*, 4*a* and *b*) may be used, if so desired. Desirably, the tyres (3*a* and b, 4*a* and b) are 320 by 190 millimetre balloon tyres.

In FIG. 2 and with reference to wheels/tyres 3*b* and 4*b*, a first preferred means of connection by independent free-wheeling hubs (8) is shown. Each free-wheeling hub (8) is connected at one end of the respective axle assembly (7, 19). A pivoting mounting arrangement (generally indicated by arrow 9, and described later) allows for steering of the front axle assembly (7) as the relative inclination of the platform (2) alters.

Figure 5:
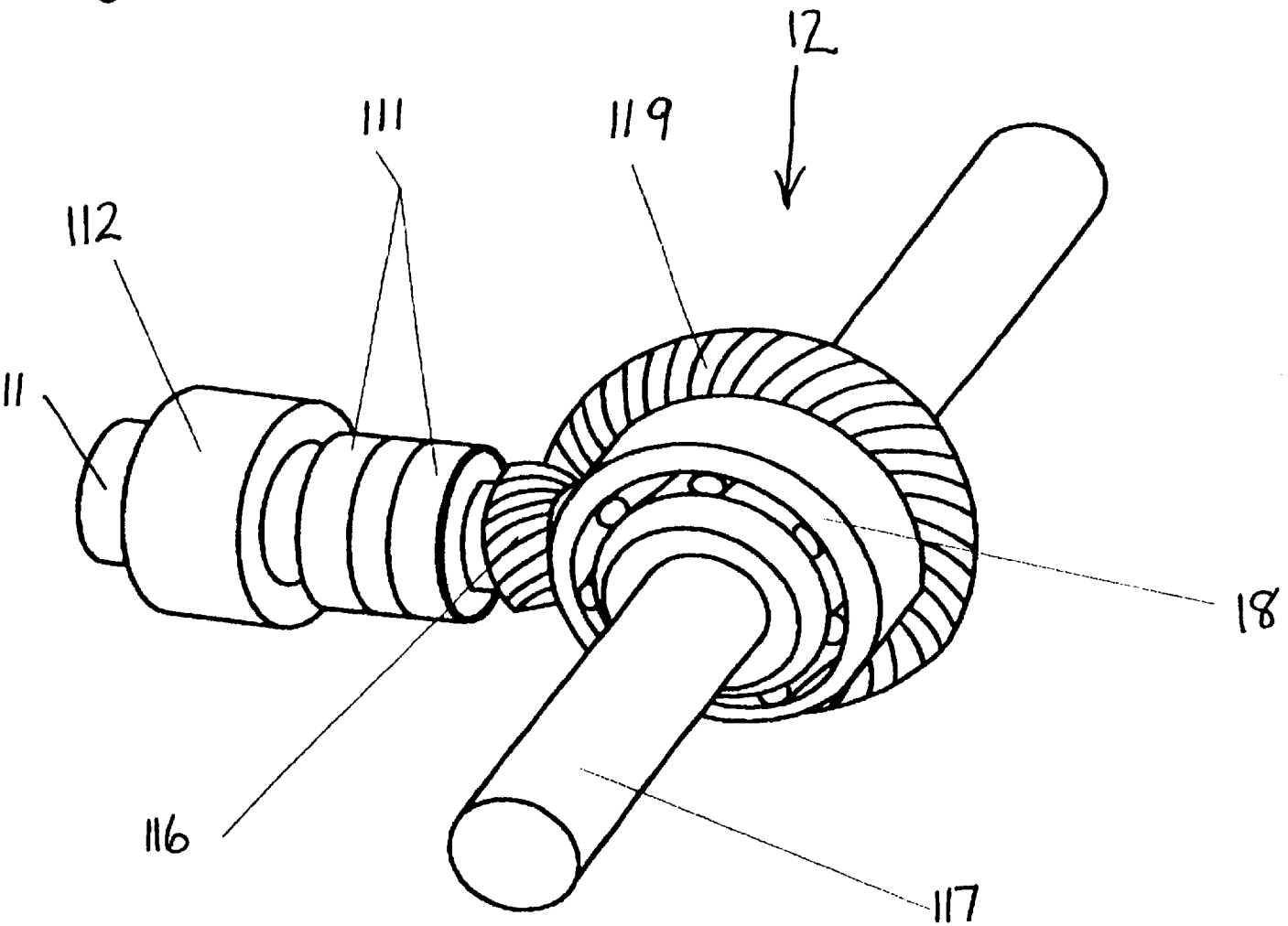
FIG. 5 is a cut-away perspective view of the same variation of the unit of FIG. 4.
Figure 6:
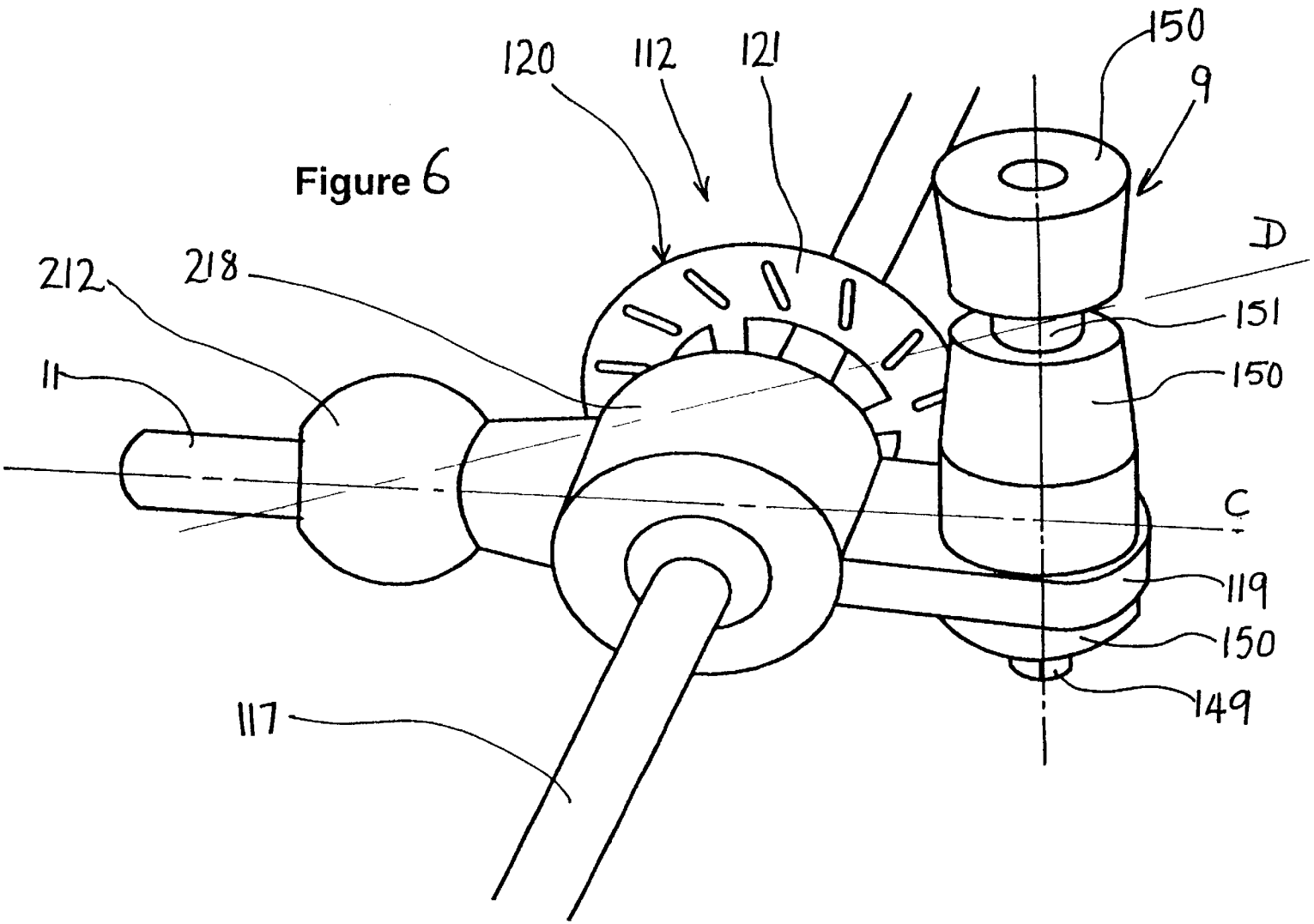
FIG. 6 is a second perspective view of the same variation of the unit of FIG. 4.

A second preferred means of connection and arrangement for the wheels (3, 4) is shown in FIGS. 5 or 6. In this second embodiment, the free-wheeling effect for the wheels (3, 4) is achieved by a centrally positioned free-wheel clutch (18), of known type.

A mid-mounted petrol driven engine (5) is provided and is connected to the wheels (3, 4) via the unit (100). The transmission unit (100) includes a front, adjustable ratio gearbox (preferably 5% overdriven) with clutch. This gearbox and clutch is labelled (10) on the drawings.

Extending from the clutch and gearbox (10) is a front drive shaft (11) which is preferably a low profile high torque unit.

To allow for changing inclinations of the front axle assembly (7) as the vehicle (1) travels over uneven terrain, and/or steering is attempted by the user (6), the front drive shaft (11) connects to a drive and front coupling assembly (12, 13), connected to the front wheels (4) through the front axle assembly (7).

The assembly (12, 13) can incorporate a number of different components, in various combinations. Referring to FIGS. 4 to 8, the various embodiments of the drive assembly (12, 13) are thereshown.

In FIG. 5, the coupling assembly (12) includes the above described embodiment of the free-wheel clutch (18). The clutch (18) is centrally positioned on the axle (117). The coupling assembly (12) further includes a crown wheel (119), pinion (116), bearings (111) and flexible coupling (112). The coupling (112) is connected to the drive shaft (11). The assembly (12) is of known type.

In FIG. 6, the case of the embodiment of the coupling assembly (112) is shown. The assembly (112) includes a spherical coupling (212) connected to the drive shaft (11). The spherical coupling (212) is a ball-joint type assembly with drive being transmitted through bearings and gearing within the spherical coupling (212) and the transmission casing (218), to the axle (117). The bearings and gearing (not shown in detail) are of known type.

The rear coupling assembly (14) is shown in FIG. 2. The assembly (14) is very similar to the second preferred embodiment of the front assembly (112). The assembly (14) comprises a rear clutch and gearbox assembly which is shown as incorporated into the engine (5). If so desired, the ratio gearbox is adjustable, and includes a pull start mechanism (not shown) for the engine(s). The rear drive shaft (16) also connects to a spherical coupling unit (17) including means for transmitting torque therethrough, and is again distributed via a rear axle assembly (18) to the rear axle (118).

Figure 4:
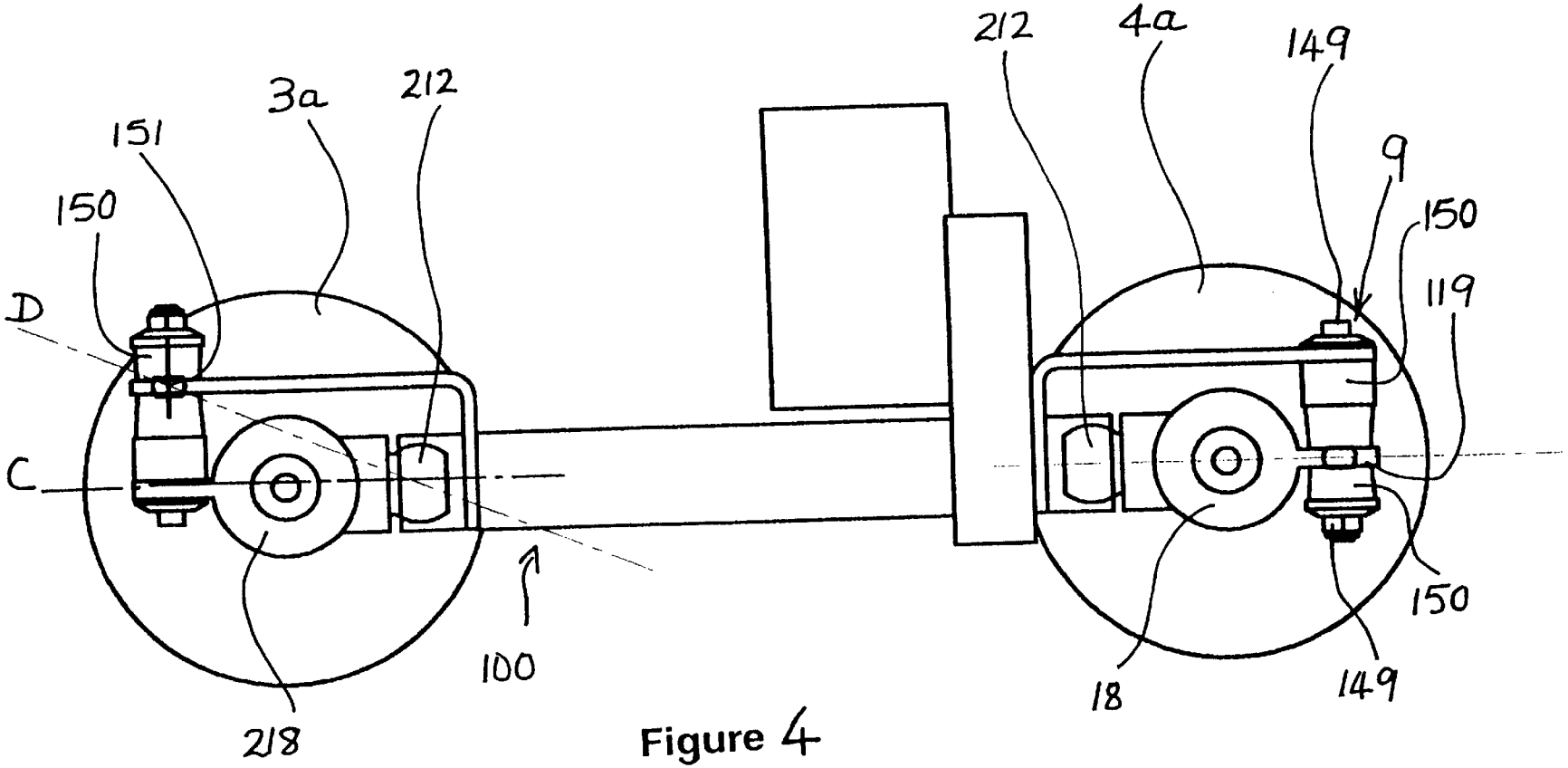
FIG. 4 is a side section view of a preferred embodiment of the invention showing two variations of the transmission unit.

In FIGS. 2 and 4, the unit (100) is drawn as showing a drive assembly (12, 13, 14) for both the front and back axle assemblies (7, 19), providing four wheel drive. However, it will be appreciated that the unit (100) and vehicle (1) may be two wheel drive only. In such an embodiment, the rear shaft (16) would be simply connected to the rear axle (118) in known manner (not shown).

Referring to FIGS. 2, or 6 two embodiments of the braking assembly (20, 120) are shown. In FIG. 2, the braking assembly (20) is hub-mounted and is adjacent the free-wheeling hub assembly (8). In FIG. 6, the second embodiment of the braking assembly (120) is centrally mounted. The second braking assembly (120) incorporates a disc brake rotor (121), of known type.

Figure 8:
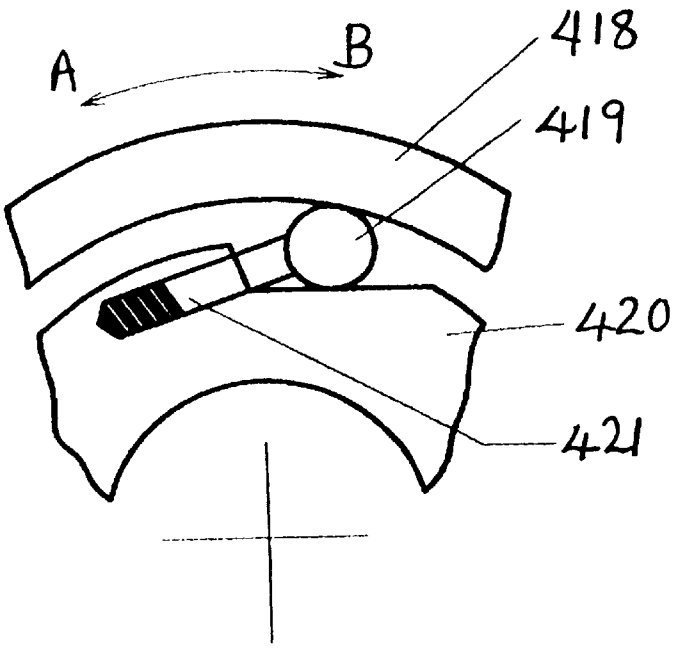
FIG. 8 is a partial section view of a second embodiment of the free-wheeling clutch of the present invention.
Figure 7:
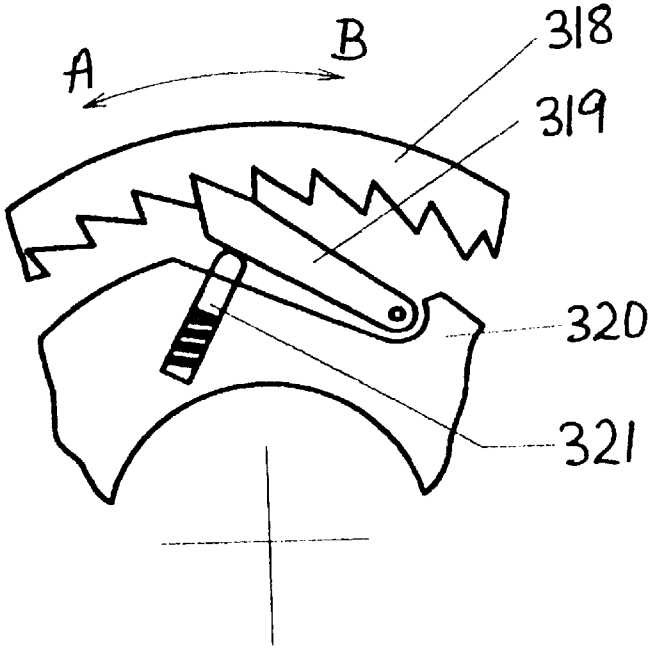
FIG. 7 is a partial section view of one embodiment of the free-wheeling clutch of the present invention.

Referring to FIGS. 7 and 8, two preferred embodiments of the clutch (18) are thereshown. In FIG. 7 the assembly (18) includes a ratchet and pawl type of clutch, with an outer ratchet (318), a pawl (319), an inner race (320) and a spring loaded plunger (321). The assembly moves between a free-wheel position (arrow A) and a locked wheel position (arrow B), in known manner.

Referring to FIG. 8, a second embodiment of the clutch assembly includes a roller clutch, with an outer race (418), a locking roller (419), an inner race (420) and a spring loaded plunger (421). The assembly moves between a free-wheel position (arrow A) and a locked wheel position (arrow B), in known manner.

Referring to FIGS. 1 to 3, 4 and 6, two embodiments of the front axle assembly (7) which detail the arrangement for steering assistance are shown. In FIGS. 1 to 3 and 6, this steering arrangement is generally termed the pivoting mounting arrangement (9). Referring to FIGS. 4 and 6, the mounting arrangement (9) includes a rigid flange (119) connected to the casing (18, 218) and front axle (117) of the assembly (7). The flange (119) incorporates a hole therethrough for an upright bolt and nut (149). The bolt also passes through a hole on the platform (2). Absorbent bumpers (150) may be added at least at two or three positions—above the platform (2) below the nut, below the platform and above the flange (119), and below the flange (119), as is desired. The bumpers (150) are constructed of urethane, or other shock absorbent material.

A further embodiment of the mounting arrangement (9) includes an arrangement of the flange (119) and bolt and nut (149) such that the axis of the nut and bolt assembly (149) passes through the front axle assembly (7).

In one option of the mounting arrangement, as shown in FIG. 4 with reference to the wheel (3*a*), an imaginary line (D), about which the platform (2) pivots, can be drawn between the pivot point (151) on the platform (2) and the centre of the spherical coupling (212). The platform (2) will pivot about line D, in addition to being able to pivot about the longitudinal axis (C) of the vehicle (1). Preferably the angle between the lines C and D is between 0° and 45°, preferably 30°.

The platform (2) also, in the illustrated embodiment in FIGS. 1 to 3, is moulded to form part of the body of the vehicle (1) and provide a protective covering for the components described above. Mudguards **(2*a*) may also be fashioned into the platform (2), though the exact design of the platform (2)** is largely a matter of user choice.

Referring to FIG. 1, snow board type bindings and shoes (25) are also provided at the front and rear of the platform (2) enabling the user (6) to engage with the platform (2). A simpler arrangement, by the provision of front and rear straps (not shown) may be provided, if so desired.

Figure 9:
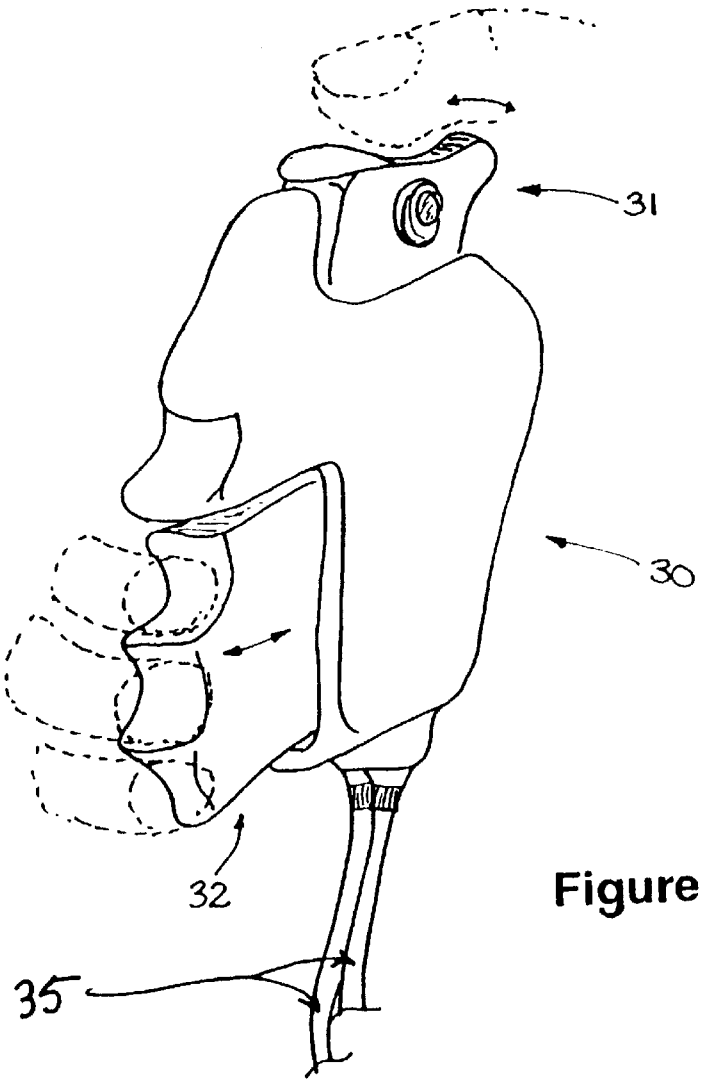
FIG. 9 is a perspective diagrammatic view of a first preferred embodiment of the hand-piece unit of the present invention.

Optionally, control of acceleration and deceleration of the vehicle is by a device such as the hand held remote control unit. A first preferred embodiment of such a unit is the control unit (30) illustrated in FIG. 9. The unit (30) comprises two variable position triggers (31, 32) to control acceleration and braking, though the exact configuration and arrangement of controls can be adjusted to suit the preferences or requirements of the user (6).

Figure 10:
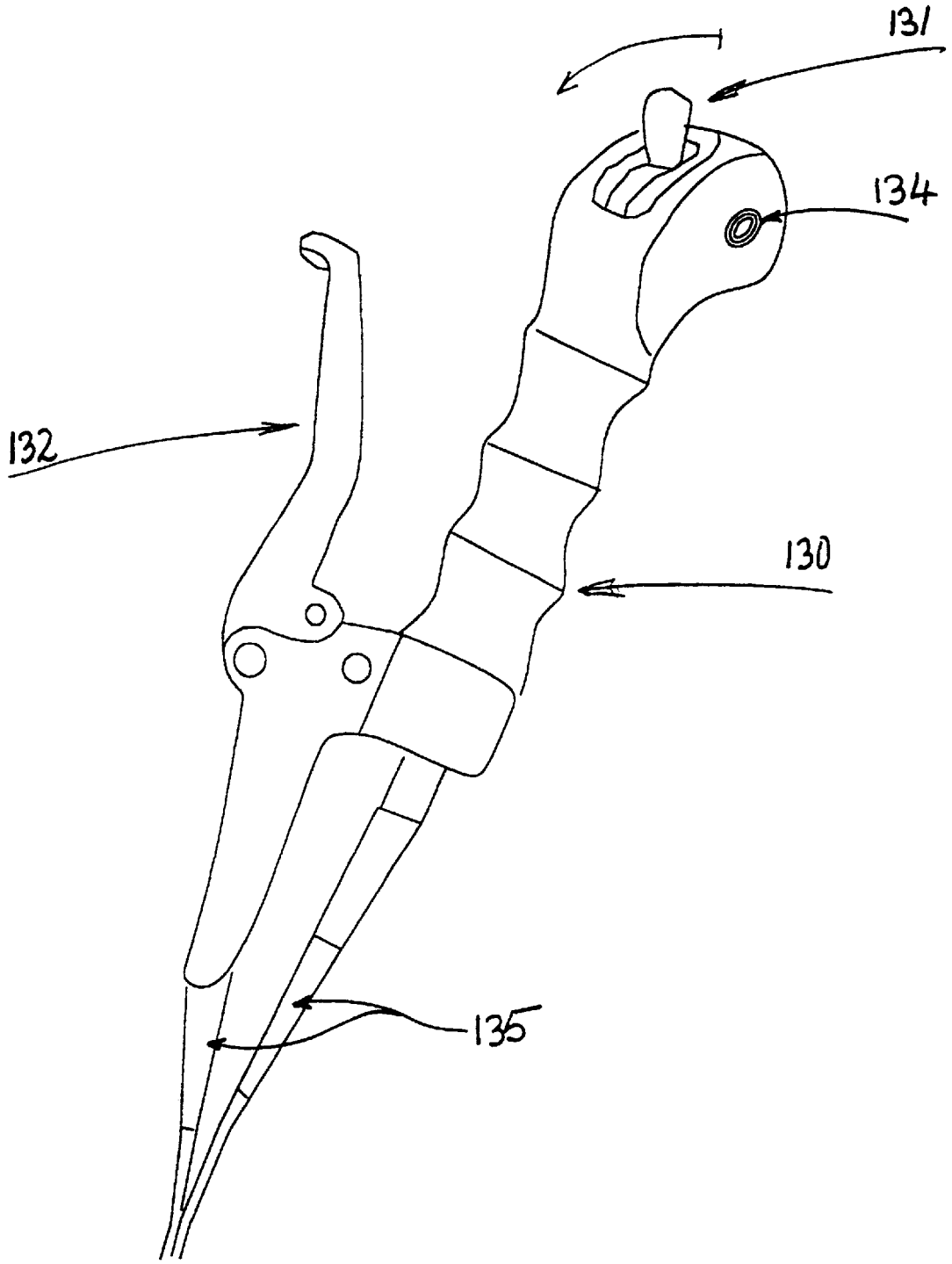
FIG. 10 is a perspective diagrammatic view of a second preferred embodiment of the hand piece unit of the present invention.

A second preferred embodiment of the control unit (130) is illustrated in FIG. 10. As with the first embodiment, the unit 130 includes two variable position triggers (131, 132). An engine shut off switch (134) is included as part of the throttle control (131). The braking is control by trigger (132).

The preferred method of actuation and control of the control unit (30, 130) is via digital proportional control which allows for incremental advance (rather than on/off switching) of the control mechanisms (31, 131, 32, 132) for the motor and braking assemblies. The method of communication may be via a wired attachment (35, 135), or by a wireless mechanism.

Typically, acceleration comprises progressive opening of the throttle and differs very little from the techniques used for controlling model aircraft engine speeds.

Braking may be achieved in a similar manner, with progressive control of a brake cylinder or brake line, which may be power assisted, to effect closing of the brake pads onto the brake discs.

A number of different variations for effecting control of the motor and braking assemblies may be employed, and standard techniques used in the radio control and model fields may be drawn upon and used herein.

As can be appreciated, the invention generally described herein may be adapted in a number of ways. However, it is envisaged that many modifications and adaptations may be made to the illustrated design of unit (100) and vehicle (1) based on the description given herein, and it is envisaged that these all form part of the present invention.

Aspects of the present invention have been described by way of example only and it should be appreciated that modifications and additions may be made thereto without departing from the scope thereof.

What is claimed is:

1. A motorized vehicle steerable by the user's lateral weight transfer, the vehicle comprising:

a platform for supporting the user;

transversely extending front and rear axle assemblies each having an inboard side, each of said front and rear axle assemblies supporting ground-engaging wheels or tracks positioned on respective sides of a central longitudinal upright plane of the vehicle, at least one axle assembly being a driven axle assembly wherein the respective wheels or tracks of such driven axle assembly are fixed thereto in driven relationship;

coupling structure pivotally coupling each of the front and rear axle assemblies relative to the platform for pivoting about respective front and rear steering axes substantially positioned in said central longitudinal plane;

an inboard joint positioned on the inboard side of each of the axle assemblies and operatively connecting the axle assembly to the platform, each of said inboard joints having a pivot center;

a resilient joint positioned on each of the axle assemblies outboard of each inboard joint and operatively connecting the axle assembly to the platform, each resilient joint having resilient means for providing suspension and also biasing the respective axle assembly to a position substantially perpendicular to the central plane, each of said resilient joints having a pivot center, each steering axis lying substantially on a line between the pivot center of the respective resilient joint and the pivot center of the respective resilient joint;

a motor;

braking means; and a transmission connected to the motor for driving at least one driven wheel or track throughout the pivoting of each driven axle assembly about its steering axis, wherein the transmission includes a driveshaft section that rotates about a transmission axis intersecting with the pivot center of the inboard joint connected to each driven axle assembly.

2. A vehicle as claimed in claim 1, wherein the inboard joint connected to each driven axle assembly is a spherical joint and the driveshaft section is connected to a flexible coupling positioned centrally within the spherical joint, the flexible joint being connected to a right-angled geared drive for driving the at least one driven axle connected to the driven wheels or tracks.

3. A vehicle as claimed in claim 2, wherein said motor is centrally positioned on said vehicle and fixed to said platform and wherein each of said wheels is a driven wheel drivingly connected to said motor and each axle assembly is fixed to a pair of said driven wheels positioned at the extremities of the vehicle.

4. A vehicle as claimed in claim 1, wherein the transmission further includes a freewheel drive hub fixed to each driven wheel or track.

5. A vehicle as claimed in claim 4, wherein the braking means are fixed to at least one pair of opposing hubs.

6. A vehicle as claimed in claim 4, wherein the freewheel drive hub includes a reverse-rotation-preventing roller clutch or pawl clutch.

7. A vehicle as claimed in claim 1, further including a hand-operated remote control for controlling the motor and the braking means.

* * * * *